US005596939A

United States Patent [19]

LaVelle et al.

[11] Patent Number: 5,596,939

[45] Date of Patent: Jan. 28, 1997

[54] APPARATUS FOR FORMING TUBULAR COLLARS

[75] Inventors: Edward R. LaVelle, Staley; Robert E. Butler, Fairmont, both of N.C.

[73] Assignee: Sara Lee Corporation, Winston-Salem, N.C.

[21] Appl. No.: 263,881

[22] Filed: Jun. 22, 1994

[51] Int. Cl.[6] ..... D05B 33/02; D05B 35/02; D05B 41/00; B26D 1/24

[52] U.S. Cl. ..... 112/130; 112/470.33; 112/470.36; 112/475.01; 112/475.06; 83/425.4; 83/901

[58] Field of Search ..... 112/10, 304, 307, 112/217.1, 130, 475.09, 475.06, 475.01, 470.33, 470.36, 470.31; 83/425.4, 940, 96, 901, 939

[56] References Cited

U.S. PATENT DOCUMENTS

| | | | |
|---|---|---|---|
| 1,356,262 | 10/1920 | Butz | 83/96 X |
| 2,011,614 | 8/1935 | Bustamante | 83/96 |
| 2,667,132 | 1/1954 | Golden | 112/10 |
| 2,973,678 | 3/1961 | Scott et al. | 83/96 |
| 3,970,021 | 7/1976 | Meadows et al. | 112/130 X |
| 4,112,860 | 9/1978 | Ellington et al. | 112/130 X |
| 4,214,541 | 7/1980 | Zeigler et al. | 112/10 X |
| 4,589,361 | 5/1986 | Starnes et al. | 112/121.15 X |
| 4,649,782 | 3/1987 | Cavagna | 83/425.4 |
| 4,807,504 | 2/1989 | Vandermarliere | 83/939 X |
| 4,856,439 | 8/1989 | O'Neal et al. | 112/10 |
| 5,230,764 | 7/1993 | Moll | 83/901 X |

*Primary Examiner*—Ismael Izaguirre
*Attorney, Agent, or Firm*—Rhodes, Coats & Bennett, L.L.P.

[57] ABSTRACT

An apparatus for converting a length of large diameter knitted tubular fabric into a plurality of fabric bands for use in the manufacture of apparel collars, cuffs and bands. The apparatus includes a slitter adapted to cut the large diameter knitted tubular fabric into longitudinal fabric strips with opposed edges. The slitter includes a plurality of spaced fabric cutters to cut the fabric into a plurality of longitudinal fabric strips and a fabric conveyor adapted to longitudinally convey the fabric into contact with the cutters. The apparatus also includes a seamer adapted to longitudinally fold the fabric strips and seam the edges together to form a plurality of smaller diameter tubes having the same diameter as the finished collar or cuff. Finally, the apparatus includes a cutter adapted to transversely cut each of the tubes into bands having a predetermined width for use as collars or cuffs.

85 Claims, 6 Drawing Sheets

APPARATUS FOR FORMING TUBULAR COLLARS

BACKGROUND OF THE INVENTION

1. Field of the Invention

The present invention relates generally to the manufacture of apparel and, more particularly, to an apparatus for converting a length of tubular fabric into a plurality of fabric bands for use in the manufacture of apparel collars, cuffs and bands.

2. Description of the Prior Art

Apparel, in particular knitted apparel, requires a separate sewing operation to produce collars, cuffs and bands which are subsequently attached to the garment body and sleeves.

One technique is to knit a length of tubular fabric to the correct diameter, e.g. between about 16 and 20 inches (40.5 and 50.8 cms.) in circumference for a collar, and then cut the knitted tube into a plurality of collars which are sewn to the garment body. This "knit to size" method is not generally used in large manufacturing operations since the cost of capital to produce a small tube is as much as the cost to produce a larger diameter tube. For example, it would require three knitting machines forming 18 inch (45.7 cms.) collars to produce the same amount of fabric as one knitting machine forming a 54 inch (137.2 cms) diameter tube. This method does have the advantage of labor savings but the capital costs are excessive.

Accordingly, it has been industry practice to knit a large diameter tube, e.g. 54 inches, which is a multiple of the final collar or cuff size, e.g. 18 inches. The large diameter tube is then spread out onto a cutting table by hand and cut transversely into bands of the width of individual collars but 54 inches in diameter. These cut pieces are bundled and sent to another location where they are cut into individual collar lengths and then sewn into individual collars. This method does have the advantage of capital savings but the labor costs are excessive.

Thus, there remains a need for a new and improved apparatus for converting a length of tubular fabric into a plurality of fabric bands for use in the manufacture of apparel collars, cuffs and bands which achieves the labor savings of the "knit to size" method while, at the same time, also has the capital savings of the large single knitted tube.

SUMMARY OF THE INVENTION

The present invention is directed to an apparatus for converting a length of large diameter knitted tubular fabric into a plurality of fabric bands for use in the manufacture of apparel collars, cuffs and bands. The apparatus includes a slitter adapted to cut the large diameter knitted tubular fabric into longitudinal fabric strips with opposed edges. The slitter includes a plurality of spaced fabric cutters to cut the fabric into a plurality of longitudinal fabric strips and a fabric conveyor adapted to longitudinally convey the fabric into contact with the cutters. In the preferred embodiment, the apparatus includes an overhead frame having plurality of spaced rollers for separating adjacent plies of the longitudinal fabric strips.

The apparatus also includes a seamer adapted to longitudinally fold the fabric strips and seam the edges together to form a plurality of smaller diameter tubes having the same diameter as the finished collar or cuff. Finally, the apparatus includes a cutter adapted to transversely cut each of the tubes into bands having a predetermined width for use as collars or cuffs.

Accordingly, one aspect of the present invention is to provide an apparatus for converting a length of tubular fabric into a plurality of fabric bands for use in the manufacture of apparel collars, cuffs and bands. The apparatus includes: (a) a slitter adapted to cut the tubular fabric into longitudinal fabric strips with opposed edges; (b) a seamer adapted to longitudinally fold the fabric strips and seam the edges together to form a plurality of tubes; and (c) a cutter adapted to transversely cut each of the tubes into bands having a predetermined width.

Another aspect of the present invention is to provide a slitter for an apparatus for converting a length of tubular fabric into a plurality of fabric bands for use in the manufacture of apparel collars, cuffs and bands. The slitter includes: (a) a plurality of spaced fabric cutters to cut the fabric into a plurality of longitudinal fabric strips; and (b) a fabric conveyor adapted to longitudinally convey the fabric into contact with the cutters.

Still another aspect of the present invention is to provide an apparatus for converting a length of tubular fabric into a plurality of fabric bands for use in the manufacture of apparel collars, cuffs and bands. The apparatus includes: (a) a slitter adapted to cut the tubular fabric into longitudinal fabric strips with opposed edges, the slitter including: (i) a plurality of spaced fabric cutters to cut the fabric into a plurality of longitudinal fabric strips; and (ii) a fabric conveyor adapted to longitudinally convey the fabric into contact with the cutters; (b) means for separating adjacent plies of the longitudinal fabric strips; (c) a seamer adapted to longitudinally fold the fabric strips and seam the edges together to form a plurality of tubes; and (d) a cutter adapted to transversely cut each of the tubes into bands having a predetermined width.

These and other aspects of the present invention will become apparent to those skilled in the art after a reading of the following description of the preferred embodiment when considered with the drawings.

DESCRIPTION OF THE PREFERRED EMBODIMENTS

Figure 1:
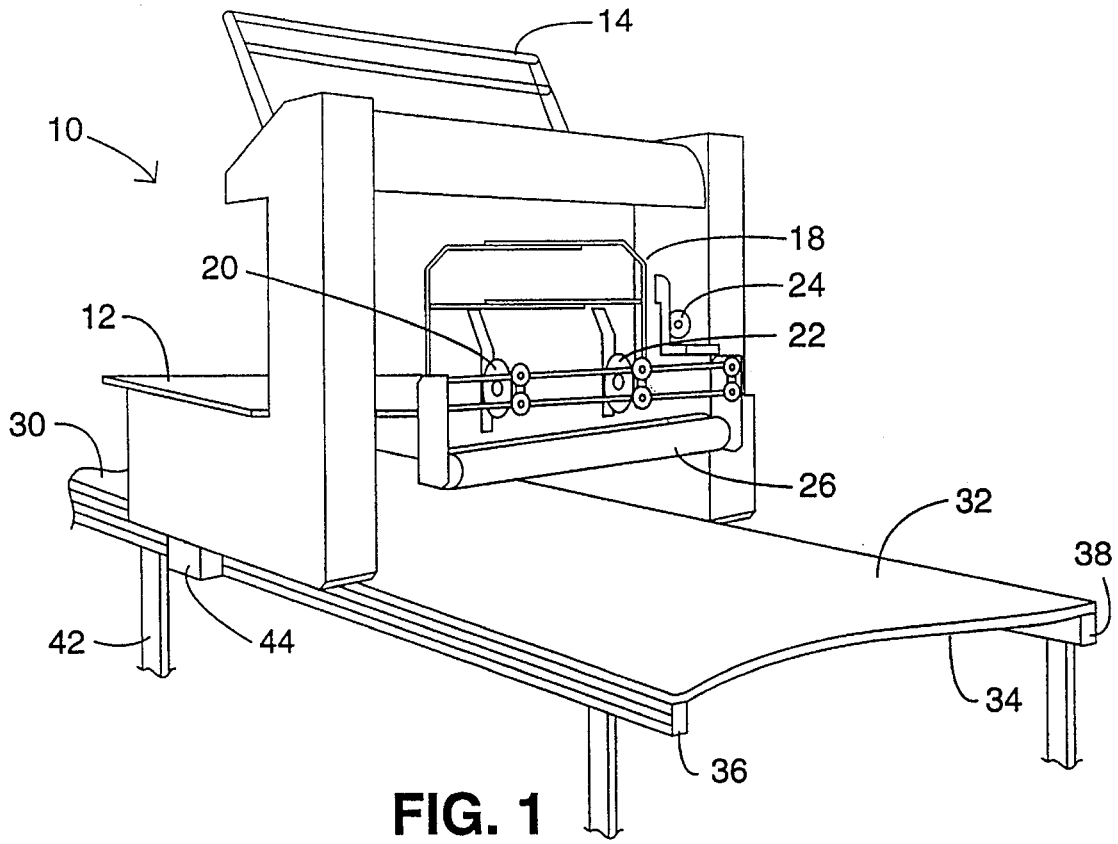
FIG. 1 is a schematic, perspective view illustrating a slitter constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 2:
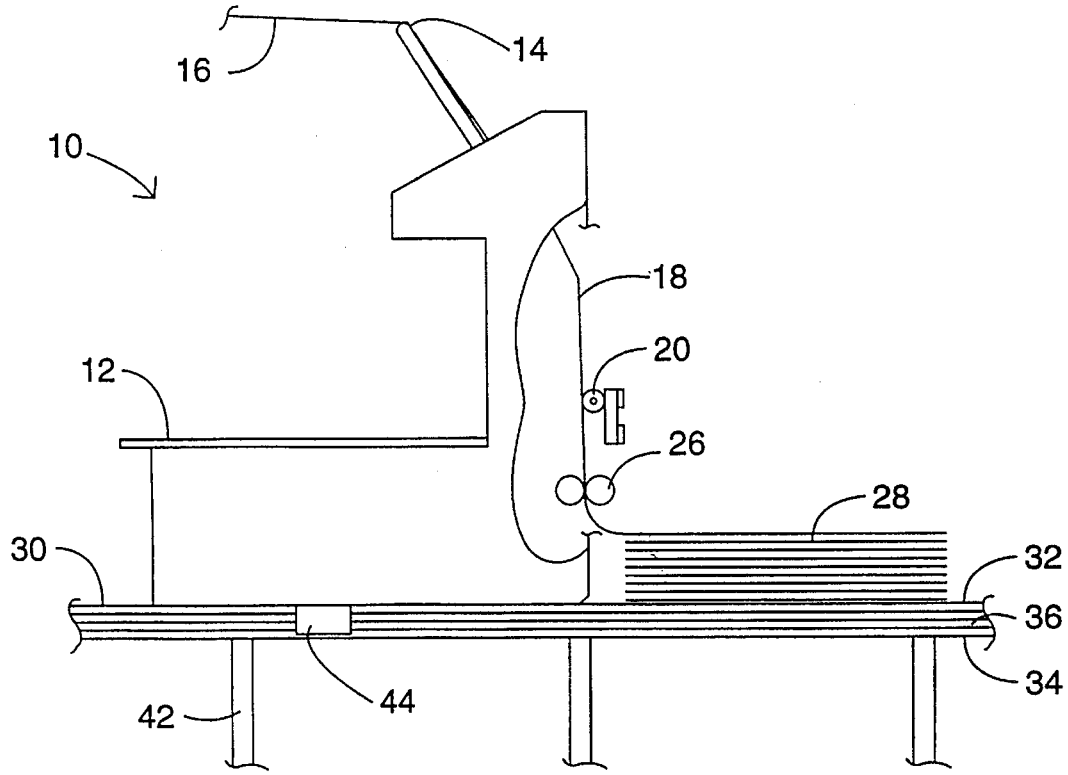
FIG. 2 is a schematic, side view of the slitter.
Figure 3:
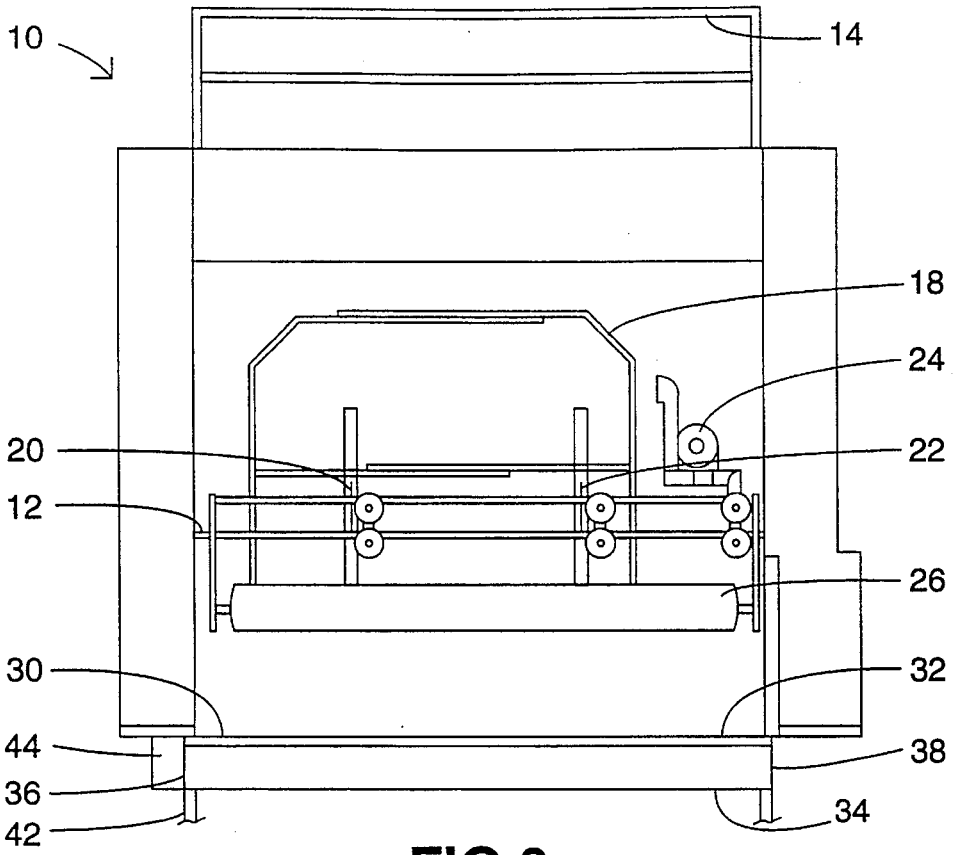
FIG. 3 is a schematic, frontal view of the slitter.

Referring now to the drawings in general and FIGS. 1–3 in particular, it will be understood that the illustrations are for the purpose of describing a preferred embodiment of the invention and are not intended to limit the invention thereto. The tubular collar making apparatus of the present invention includes three major sub-assemblies: a slitter 10; a seamer 48; and a collar cutter 66.

The slitter, generally designated 10, of the present invention includes a carriage 12, cut away to illustrate the other elements of the slitter. Carriage 12 supports a horizontal bar 14 positioned to guide a tubular fabric 16 to be cut; an adjustable spreader frame 18 serving to maintain tubular fabric 16 in a taut, flattened configuration; fabric cutters 20 and 22 positioned to contact the surface of fabric 16; fabric cutter 24 positioned to contact the edge of fabric 16; and a pair of drive rollers 26, adapted to draw fabric 16 over bar 14 and frame 18 and into contact with cutters 20, 22 and 24. Cutters 20, 22 and 24 are illustrated in greater detail in FIG. 10 hereinafter.

Fabric strips 28, produced by slitting tubular fabric 16 are discharged from drive rollers 26 of slitter 10 onto the surface of a table, generally designated 30, which, in the preferred embodiment, includes an air-permeable top 32, and a bottom 34, joined by sides 36 and 38, and ends, not shown, to form an interior chamber 40. An air pump, not shown, pumps air into chamber 40. The air then exits through the surface of top 32 to enable the operator to "float" the cut fabric from the slitter table to the seamer. A frame 42 supports table 30 above the floor.

Carriage 12 is mounted on a pair of guide rails 44 and 46 mounted on sides 36 and 38, respectively, of table 30. A drive means, not shown, drives carriage 12 back and forth over top 32 as fabric strips 28 are produced, resulting in fabric strips 28 being deposited on top 32 in an layered configuration.

Figure 4:
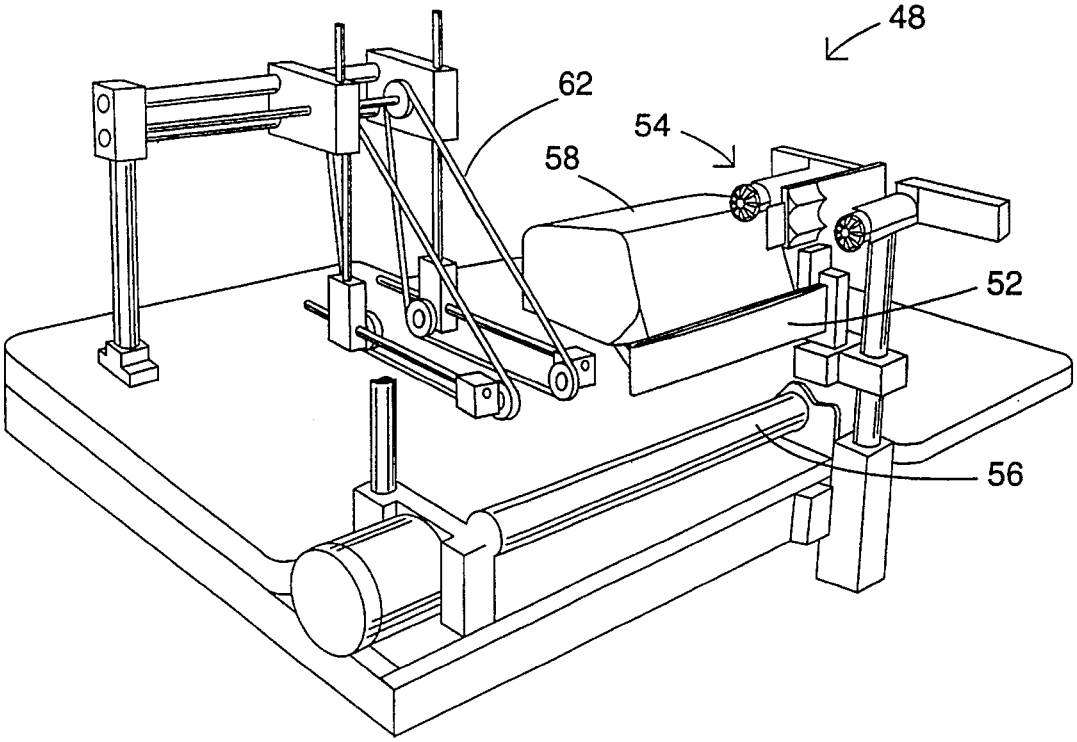
FIG. 4 is a schematic, perspective view of the seamer.
Figure 5:
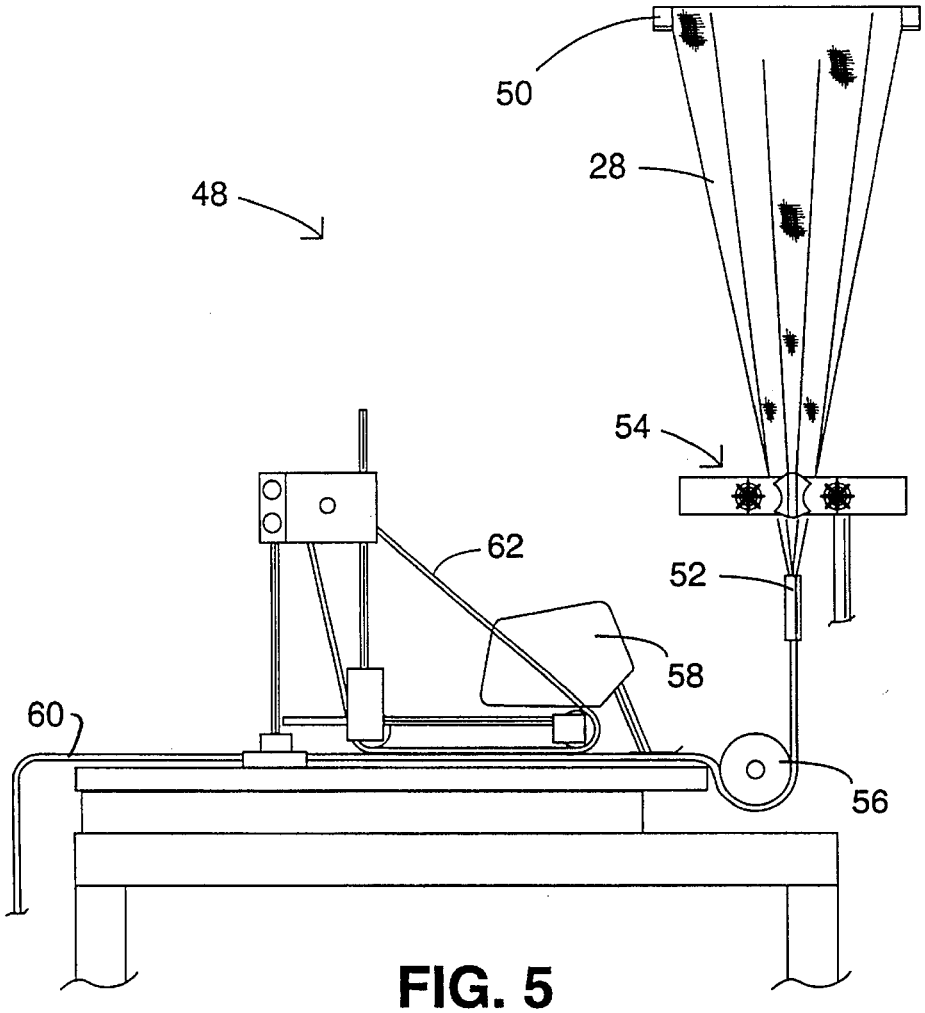
FIG. 5 is a schematic, side view of the seamer.
Figure 6:
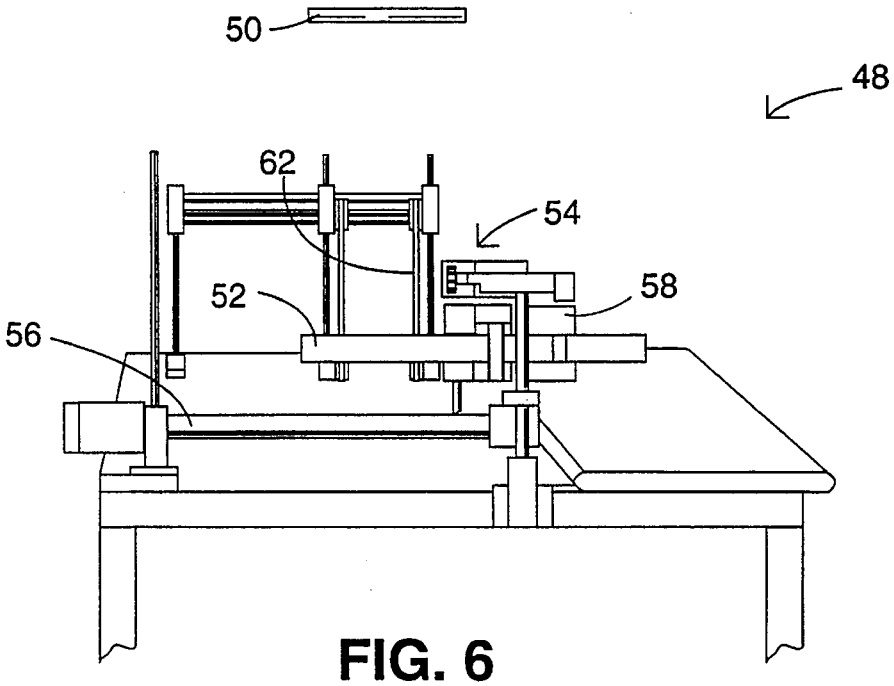
FIG. 6 is a schematic, frontal view of the seamer.
Figure 7:
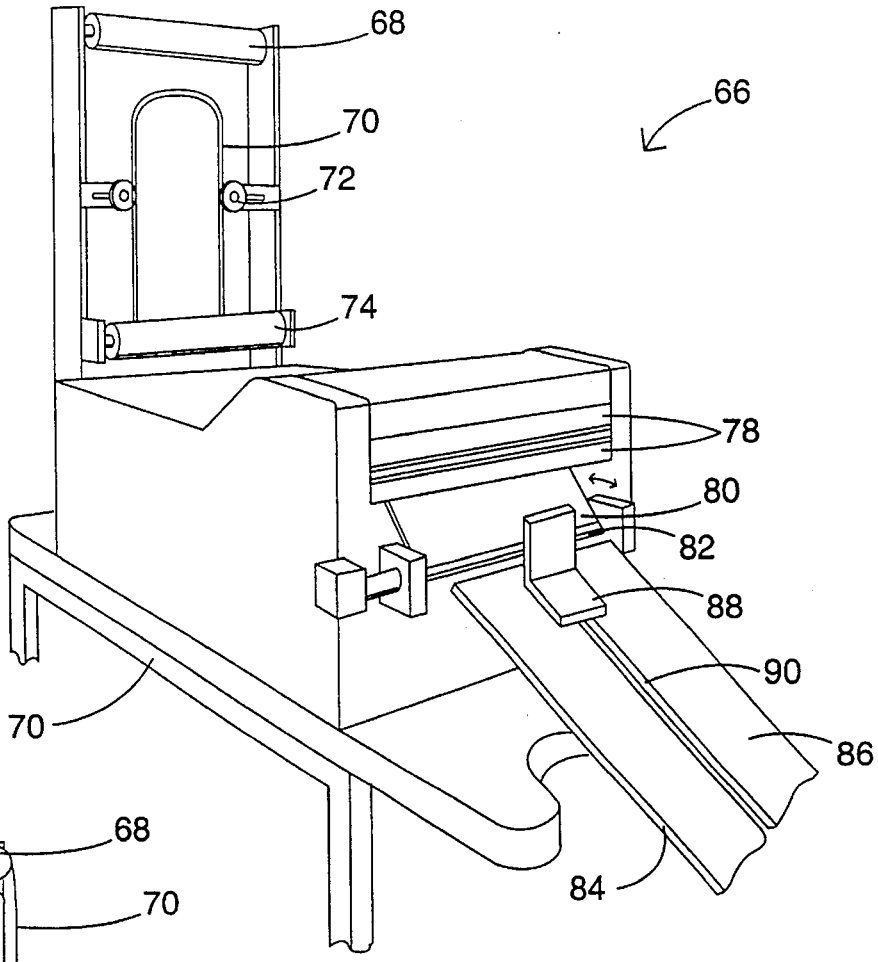
FIG. 7 is a schematic, perspective view of the cutter.
Figure 8:
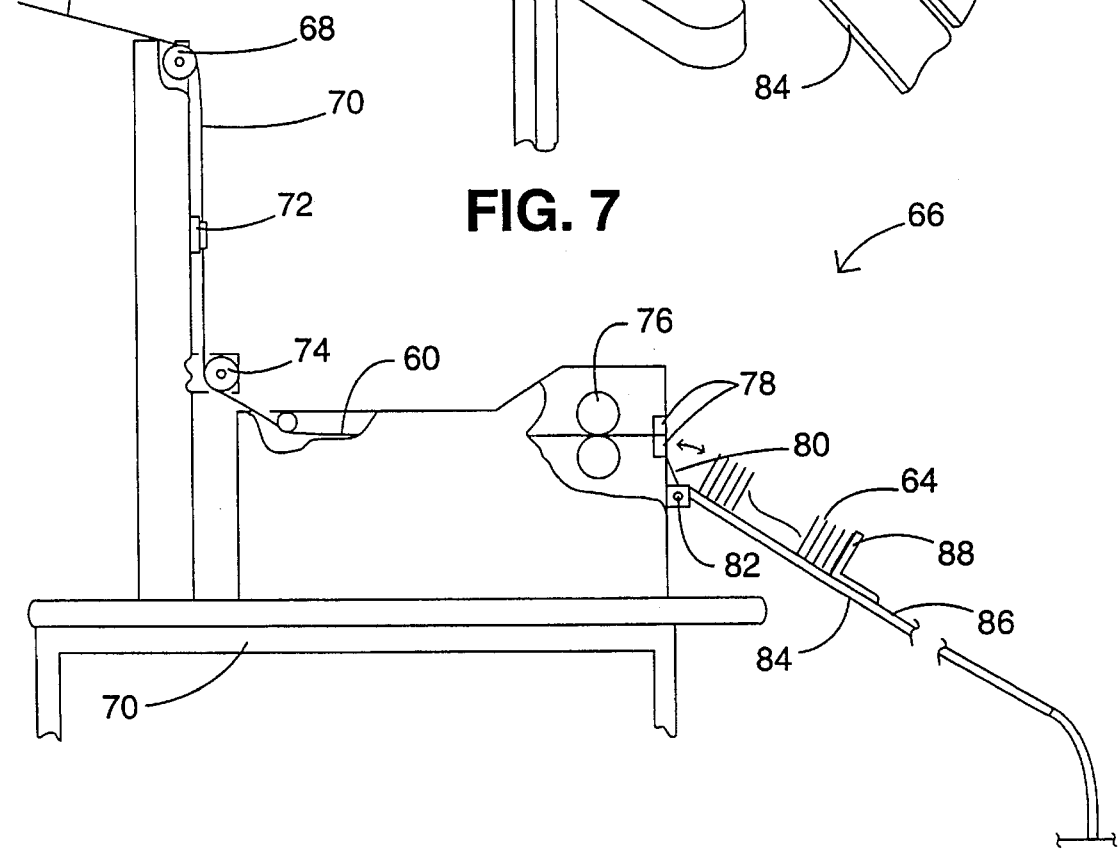
FIG. 8 is a schematic, side view of the cutter.
Figure 9:
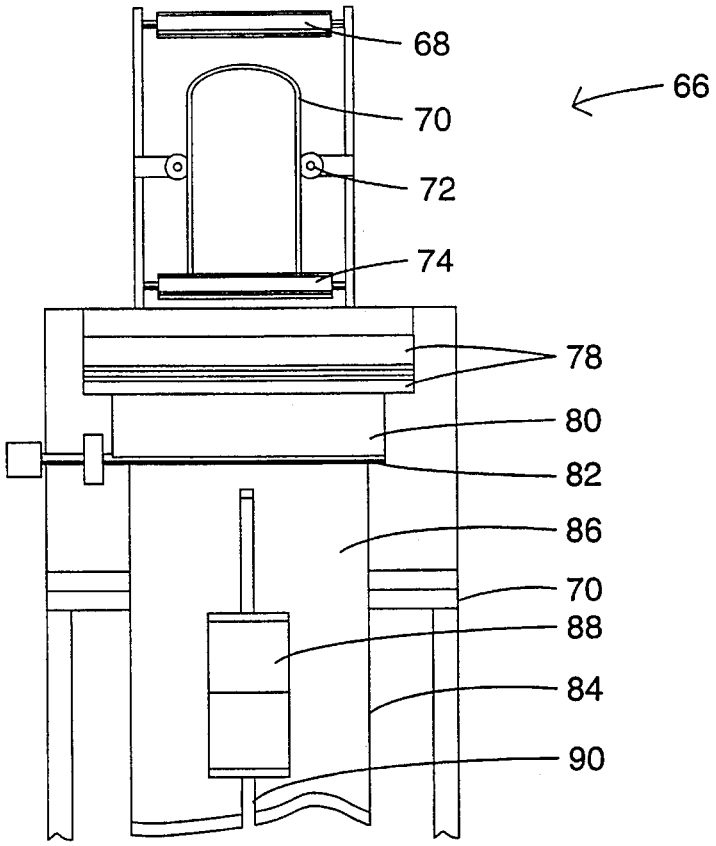
FIG. 9 is a schematic, frontal view of the cutter.

Referring now to FIGS. 4–6, fabric strips 28 are taken from slitter 10 to a seamer, generally designated 48, where the edges of fabric strips 28 are sewn together to form tubes having a smaller circumference than that of the original tubular fabric 16.

Seamer 48 includes a horizontal guide bar 50, positioned to guide strip 28; a folder 52, to fold the edges of strip 28 together; an edge controller 54, to position the edges in the proper location for sewing; and a pair of drive rollers 56, rotated by a drive means, not shown, to draw strip 28 over guide bar 50, past edge controller 54 and through folder 52 to a sewing machine, generally designated 58, where the edges are sewn together. Folder 52 and edge controller 54 are illustrated in greater detail in FIG. 11 hereinafter.

Sewing machine 56 is of conventional design, and thus will not be described in detail. Basically, sewing machine 58 stitches the edges of strip 28 together to form a continuous smaller diameter tube 60. While different kinds of stitches can be used, a 16 stitch is preferred. A feeder 62, driven by a drive means, not shown, feeds fabric strip 28 through sewing machine 56. The sewn tube is received into an accumulator for subsequent cutting.

Tube 60 is cut into a plurality of bands 64, suitable for use in making collars, cuffs and bands for apparel by a cutter, generally designated 66, which includes a horizontal guide roll 68 to direct tube 60; a spreader frame 70 to flatten tube 60 and maintain it in a taut, flattened configuration; guide rollers 72 to position flattened tube 60; a pair of nip rollers 74; a pair of drive rollers 76 to pull the tube over roll 68, over frame 70, between guide rollers 72, and through nip rollers 74.

Tube 60, exiting drive rollers 76 passes under a guillotine blade 78 which cuts tube 60 transversely to form fabric bands 64 having a pre-determined width. Bands 64 drop from guillotine 78 onto a stacker having a flipper plate 80, which pivots about pin 82 to move bands 64 from beneath guillotine 78; a accumulator table, generally designated 84, having a receiving surface 86 extending downwardly from guillotine 78, to receive bands 60; and a vertical stop 88, mounted on surface 86 within a slot 90 prevents the bands from dropping from surface 86. Stop 88 is moved along slot 90 and away from guillotine 78 in a step-wise fashion as bands 64 are deposited on surface 86 by a drive means, not shown.

Figure 10:
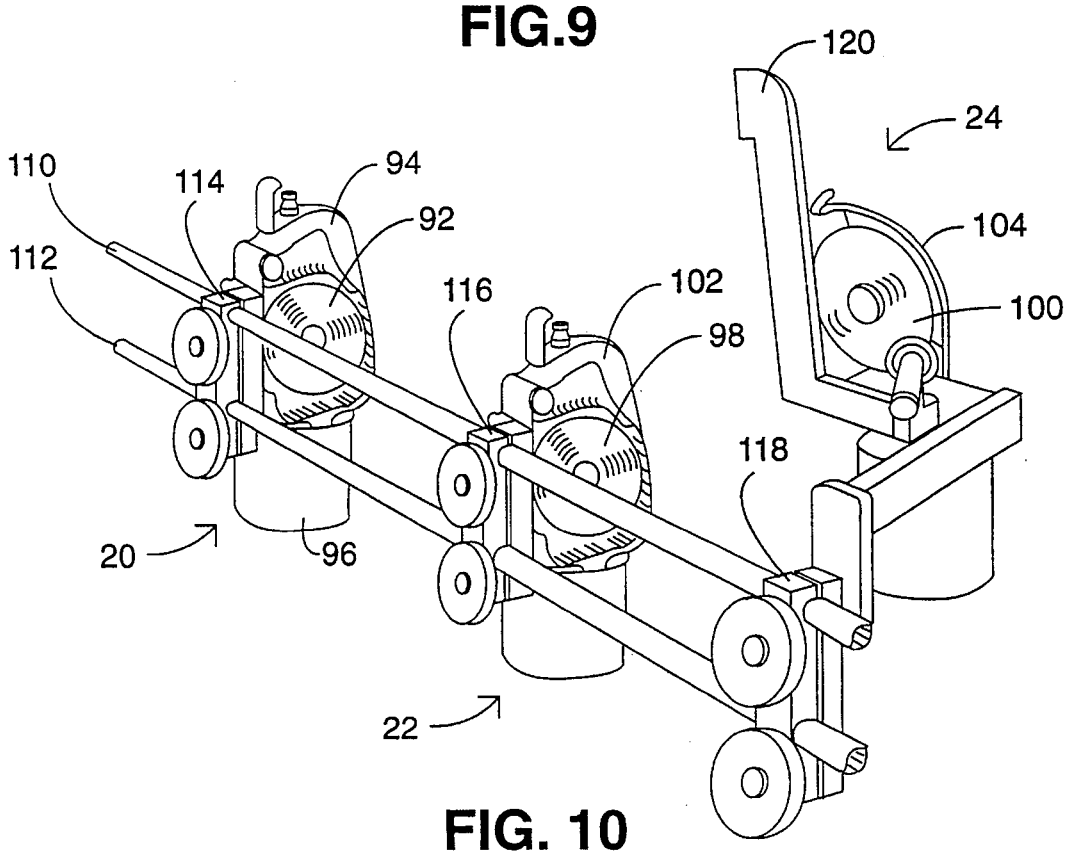
FIG. 10 is a detailed, perspective view of the fabric cutters forming parts of the slitter.

As best seen in FIG. 10, cutter 20, forming a part of slitter 10, includes a rotatable blade 92 which is supported within a housing 94 and rotated by a drive motor 96 through gearing, not shown. Similarly cutters 22 and 24 include blades 98 and 100; housings 102 and 104; and drive motors 106 and 108, respectively. Cutters 20, 22 and 24 are positioned on a pair of horizontal guide rails 110 and 112 by adjustable mounts 114, 116 and 118, attached to housings 94, 102 and 104, respectively. A fabric guide 120 mounted on cutter 24, guides the folded edge of tubular fabric 16 into contact with blade 100.

Figure 11:
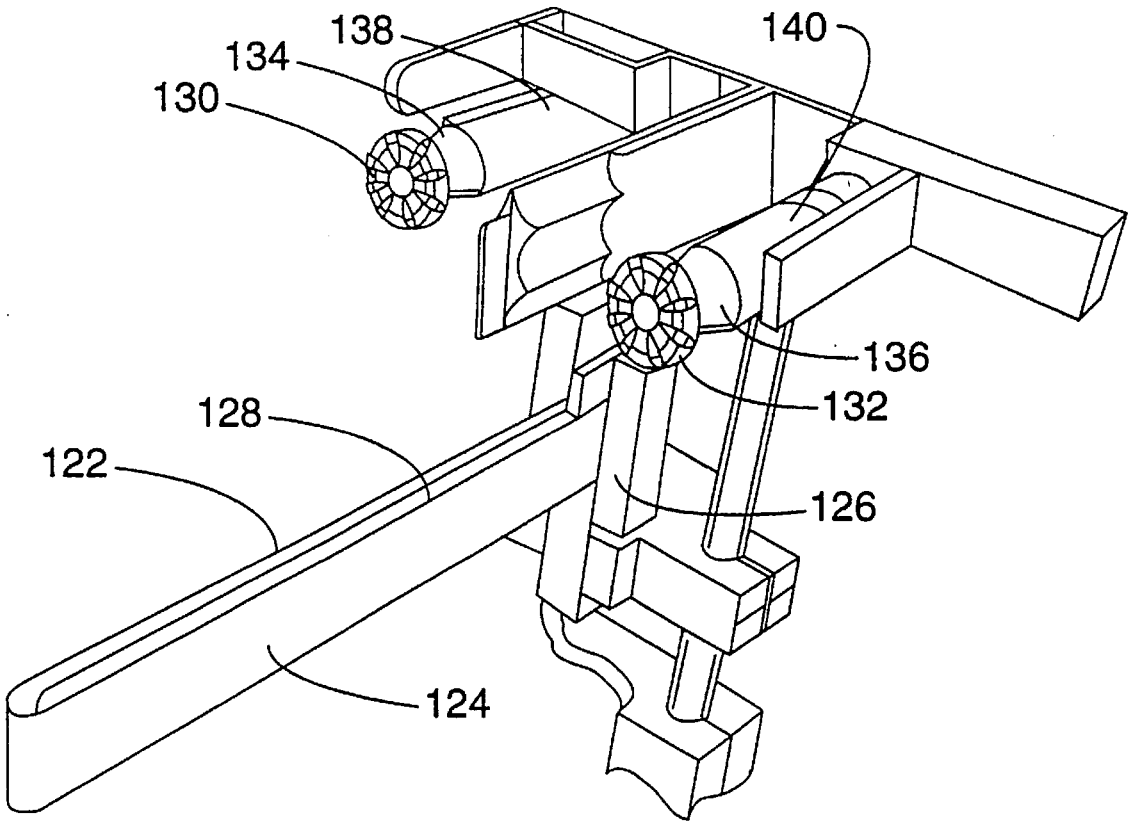
FIG. 11 is a detailed, perspective view of the folder and edge controller forming parts of the seamer.

As best seen in FIG. 11, folder 52, forming a part of seamer 48, includes a pair of spaced, parallel outer guide strips 122 and 124 having inner ends affixed to a supporting frame 126 and inwardly curved outer ends integral with each other. An inner guide strip 128 having an inner end affixed to frame 126 and an unattached outer end spaced from the outer ends of strips 122 and 124 is positioned parallel to, and equidistant between the inner surfaces of strips 122 and 124.

Edge controller 54, also shown in FIG. 11, includes a pair of toothed gripper wheels 130 and 132, freely rotatable at the ends of axially extendable shafts 134 and 136, respectively. Shafts 134 and 136 are held within housings 138 and 140, which are adapted to pivot outwardly to a open position to facilitate set-up and inwardly to bring wheels 130 and 132 into contact with a fabric positioned therebetween. Shafts 134 and 136 are adapted to move inwardly or outwardly when the edge of fabric strip 28 moves out of the desired alignment with sewing machine 58.

In operation, tubular fabric 16 is first directed to slitter 10 over guide bar 14 and stretched over spreader frame 18 to take on a flattened configuration in the form of two parallel, abutting fabric strips with parallel adjoining edges. Flattened fabric 16 is drawn by drive rollers 26 past cutters 20, 22 which longitudinally sever the strip portions on fabric 16 at pre-determined distances between the adjoining edges and past cutter 24 which severs fabric 16 along an adjoining edge.

The resultant fabric strips are laid onto top 32 of table 30 in a lapped configuration, resulting from the reciprocal movement of carriage 12, which supports the aforesaid bar 14, frame 18, cutters 20, 22 and 24, and drive rollers 26 along rails 44 and 46 which are horizontally positioned along the sides of table 30.

Fabric strips 28 are then directed to seamer 48, where they are sewn into smaller tubes which are the same diameter as a tubular collar. At seamer 48, fabric strips 28 are directed over horizontal guide bar 50 to folder 52, where the fabric is inserted through the opening formed between outer guide strips 122 and 124, and inner guide strip 128, with the edges of fabric strip 28 facing supporting frame 126. Thus, fabric strip 28, as it exits folder 52, has one-half longitudinally folded over the other one-half, so that the edges of strip 28 are adjacent one another.

Strip 28, now folded, is then moved through sewing machine 58 which stitches the overlapped fabric together to form tube 60. The edges of strip 28 are positioned properly in relationship to sewing machine 58 with edge controller 54, which grips the edges of strip 28 with toothed wheels 130 and 132, which are moved inwardly or outwardly as needed by moving axial shafts 134 and 136 inwardly or outwardly, as needed, when the strip is out of the desired alignment. Folded strip 28, sewn to form tube 60, is drawn through sewing machine 58 by feeder 62 into an accumulator.

Tube 60 is then directed to cutter 66, where it is passed over guide roll 68 and over stretcher frame 70, which flattens tube 60. Guide rolls 72 position tube 60 for subsequent cutting. Drive rollers 76 pull tube 60 through nip rollers 74 into guillotine blade 78, which transversely cuts tube 60 into a plurality of collar bands 64.

Bands 74 fall from guillotine 78 onto flipper plate 80, which is adapted to pivot about pin 82 after each cut by guillotine blade 78, to transfer the cut band to an accumulator table 84, where bands 64 are held in a stacked vertical arrangement against the face of vertical stop 88, which is adapted to move along table 84 away from guillotine blade 78 as bands 64 are transferred to table 84. The collar or cuff bands produced by the present invention are attached to garments in a conventional manner.

Certain modifications and improvements will occur to those skilled in the art upon a reading of the foregoing description. By way of example, a cross cutting blade could be use in place of the guillotine blade. Also different types of edge controllers could be used. Finally, air floatation tables could be used to help the operator move the cloth from one station to another. It should be understood that all such modifications and improvements have been deleted herein for the sake of conciseness and readability but are properly within the scope of the following claims.

We claim:

1. An apparatus for converting a length of tubular fabric into a plurality of fabric bands for use in the manufacture of apparel collars, cuffs and bands, said apparatus comprising:

(a) a slitter adapted to cut said tubular fabric into longitudinal fabric strips with opposed edges;

(b) an overhead frame located downstream of said slitter having a plurality of rollers for separating adjacent plies of said longitudinal fabric strips into individual plies;

(c) a seamer adapted to longitudinally fold said individual plies of fabric strips and to seam said edges together to form a plurality of tubes; and (d) a cutter adapted to transversely cut each of said tubes into bands having a predetermined width.

2. The apparatus according to claim 1 wherein said edge controller includes a pair of freely rotatable, gripper wheels adapted to engage said fabric and move inwardly or outwardly to align said fabric with said sewing machine.

3. The apparatus according to claim 1, wherein said cutter adapted to transversely cut said tubes into bands having a predetermined width includes a spreader adapted to spread a tube, a cutter adapted to transversely cut said tube into bands, and a feeder to feed said tube from said spreader to said cutter.

4. The apparatus according to claim 3, wherein said cutter further includes a stacker for receiving bands from said cutter.

5. The apparatus according to claim 4, wherein said stacker includes a flipper plate to transfer said bands from said cutter, an accumulator table to receive said bands, and an adjustable stop to hold said bands in an upright attitude on said table.

6. The apparatus according to claim 3, wherein said spreader includes an expandable frame for insertion within said tube and a guide for positioning said frame in relation to said cutter.

7. The apparatus according to claim 3, wherein said cutter is a guillotine cutter.

8. The apparatus according to claim 3, wherein said feeder includes a pair of drive rollers.

9. A slitter for an apparatus for converting a length of tubular fabric into a plurality of fabric bands for use in the manufacture of apparel collars, cuffs and bands, said slitter comprising:

(a) a fabric conveyor adapted to longitudinally convey said fabric;

(b) a plurality of spaced fabric cutters to cut said fabric into a plurality of longitudinal fabric strips; and (c) a table positioned to receive said fabric strips, wherein said table includes an air-permeable top and a source of pressurized air to direct air upwardly through said top, whereby fabric strips are supported upon a cushion of air.

10. The apparatus according to claim 9, wherein said conveyor includes reciprocating means for lapping said fabric strips.

11. The apparatus according to claim 9, wherein said slitter includes a spreader frame for flattening said tubular fabric prior to cutting.

12. The apparatus according to claim 9, wherein said cutters comprise a plurality of rotating blades, and guide rails for positioning said blades to contact said fabric at pre-determined locations.

13. The apparatus according to claim 9, wherein said conveyor includes a horizontal guide bar positioned above said cutters and a pair of nip rollers positioned below said cutters.

14. An apparatus for converting a length of tubular fabric into a plurality of fabric bands for use in the manufacture of apparel collars, cuffs and bands, said apparatus comprising:

(a) a slitter adapted to cut said tubular fabric into longitudinal fabric strips with opposed edges, said slitter including: (i) a plurality of spaced fabric cutters to cut said fabric into a plurality of longitudinal fabric strips; and (ii) a fabric conveyor adapted to longitudinally convey said fabric into contact with said cutters;

(b) means for separating adjacent plies of said longitudinal fabric strips into individual plies;

(c) a seamer adapted to longitudinally fold said individual plies of fabric strips and to seam said edges together to form a plurality of tubes; and (d) a cutter adapted to transversely cut each of said tubes into bands having a predetermined width.

15. The apparatus according to claim 14, wherein said means for separating adjacent plies of said longitudinal fabric strips is an overhead frame located upstream of said seamer having a plurality of rollers for separating said fabric strips.

16. The apparatus according to claim 14, wherein said edge controller includes a pair of freely rotatable, gripper wheels adapted to engage said fabric and move inwardly or outwardly to align said fabric with said sewing machine.

17. The apparatus according to claim 14, wherein said cutter adapted to transversely cut said tubes into bands having a predetermined width includes a spreader adapted to spread a tube, a cutting blade adapted to transversely cut said tube into bands, and a feeder to feed said tube from said spreader to said cutting blade.

18. The apparatus according to claim 17, wherein said cutter further includes a stacker for receiving bands from said cutter.

19. The apparatus according to claim 18, wherein said stacker includes a flipper plate to transfer said bands from said cutter, an accumulator table to receive said bands, and an adjustable stop to hold said bands in an upright attitude on said table.

20. The apparatus according to claim 17, wherein said spreader includes an expandable frame for insertion within said tube and a guide for positioning said frame in relation to said cutter.

21. The apparatus according to claim 17, wherein said cutter is a guillotine cutter.

22. The apparatus according to claim 17, wherein said feeder includes a pair of drive rollers.

23. The apparatus according to claim 14, wherein said slitter further includes a table positioned to receive said fabric strips.

24. The apparatus according to claim 23, wherein said table includes an air-permeable top and a source of pressurized air to direct air upwardly through said top, whereby fabric strips are supported upon a cushion of air.

25. The apparatus according to claim 14, wherein said conveyor includes reciprocating means for lapping said fabric strips.

26. The apparatus according to claim 14, wherein said slitter includes a spreader frame for flattening said tubular fabric prior to cutting.

27. The apparatus according to claim 14, wherein said cutters comprise a plurality of rotating blades, and guide rails for positioning said blades to contact said fabric at pre-determined locations.

28. The apparatus according to claim 14, wherein said conveyor includes a horizontal guide bar positioned above said cutters and a pair of nip rollers positioned below said cutters.

29. An apparatus for converting a length of tubular fabric into a plurality of fabric bands for use in the manufacture of apparel collars, cuffs and bands, said apparatus comprising:

(a) a slitter adapted to cut said tubular fabric into longitudinal fabric strips with opposed edges;

(b) a seamer adapted to longitudinally fold said fabric strips and to seam said edges together to form a plurality of tubes, wherein said seamer includes a folder adapted to fold the edges of said fabric strips together, an edge controller to position the edges of each of said fabric strips in position to be sewn, and a sewing machine to sew the edges of each of said fabric strips together to form a tube and wherein said folder includes a pair of spaced, parallel outer guide strips having inner ends affixed to a supporting frame and inwardly curved outer ends integral with each other, and an inner guide strip having an inner end affixed to said supporting frame and an unattached outer end spaced from the outer ends of said outer guide strips, said inner guide strip being positioned parallel to, and equidistant between the said outer guide strips; and (c) a cutter adapted to transversely cut each of said tubes into bands having a predetermined width.

30. The apparatus according to claim 29, further including means for separating adjacent plies of said longitudinal fabric strips.

31. The apparatus according to claim 30, wherein said means for separating adjacent plies of said longitudinal fabric strips is an overhead frame located upstream of said seamer having a plurality of rollers for separating said fabric strips.

32. The apparatus according to claim 29, wherein said edge controller includes a pair of freely rotatable, gripper wheels adapted to engage said fabric and move inwardly or outwardly to align said fabric with said sewing machine.

33. The apparatus according to claim 29, wherein said cutter adapted to transversely cut said tubes into bands having a predetermined width includes a spreader adapted to spread a tube, a cutter adapted to transversely cut said tube into bands, and a feeder to feed said tube from said spreader to said cutter.

34. The apparatus according to claim 33 wherein said cutter further includes a stacker for receiving bands from said cutter.

35. The apparatus according to claim 34, wherein said stacker includes a flipper plate to transfer said bands from said cutter, an accumulator table to receive said bands, and an adjustable stop to hold said bands in an upright attitude on said table.

36. The apparatus according to claim 33, wherein said spreader includes an expandable frame for insertion within said tube and a guide for positioning said frame in relation to said cutter.

37. The apparatus according to claim 33 wherein said cutter is a guillotine cutter.

38. The apparatus according to claim 33 wherein said feeder includes a pair of drive rollers.

39. A method for converting a length of tubular fabric into a plurality of fabric bands for use in the manufacture of apparel collars, cuffs and bands, said method comprising the steps of:

(a) cutting said tubular fabric into longitudinal fabric strips with opposed edges;

(b) longitudinally folding said fabric strips and seaming said edges together to form a plurality of tubes using a seamer, wherein said seamer includes a folder adapted to fold the edges of said fabric strips together, an edge controller to position the edges of each of said fabric strips in position to be sewn, and a sewing machine to sew the edges of each of said fabric strips together to form a tube and wherein said folder includes a pair of spaced, parallel outer guide strips having inner ends affixed to a supporting frame and inwardly curved outer ends integral with each other, and an inner guide strip having an inner end affixed to said supporting frame and an unattached outer end spaced from the outer ends of said outer guide strips, said inner guide strip being positioned parallel to, and equidistant between the said outer guide strips; and (c) transversely cutting each of said tubes into bands having a predetermined width.

40. An apparatus for converting a length of tubular fabric into a plurality of fabric bands for use in the manufacture of apparel collars, cuffs and bands, said apparatus comprising:

(a) a slitter adapted to cut said tubular fabric into longitudinal fabric strips with opposed edges;

(b) a seamer adapted to longitudinally fold said fabric strips and to seam said edges together to form a plurality of tubes; and (c) a cutter adapted to transversely cut each of said tubes into bands having a predetermined width; wherein said cutter includes a spreader adapted to spread a tube, a cutting blade adapted to transversely cut said tube into bands, and a feeder to feed said tube from said spreader to said cutting blade.

41. The apparatus according to claim 40, further including means for separating adjacent plies of said longitudinal fabric strips.

42. The apparatus according to claim 41, wherein said means for separating adjacent plies of said longitudinal fabric strips is an overhead frame located upstream of said seamer having a plurality of rollers for separating said fabric strips.

43. The apparatus according to claim 40, wherein said seamer includes a folder adapted to fold the edges of said fabric strips together, an edge controller to position the edges of each of said fabric strips in position to be sewn, and a sewing machine to sew the edges of each of said fabric strips together to form a tube.

44. The apparatus according to claim 43, wherein said folder includes a pair of spaced, parallel outer guide strips having inner ends affixed to a supporting frame and inwardly curved outer ends integral with each other, and an inner guide strip having an inner end affixed to said supporting frame and an unattached outer end spaced from the outer ends of said outer guide strips, said inner guide strip being positioned parallel to, and equidistant between the said outer guide strips.

45. The apparatus according to claim 43, wherein said edge controller includes a pair of freely rotatable, gripper wheels adapted to engage said fabric and move inwardly or outwardly to align said fabric with said sewing machine.

46. The apparatus according to claim 40 wherein said cutter further includes a stacker for receiving bands from said cutter.

47. The apparatus according to claim 46, wherein said stacker includes a flipper plate to transfer said bands from said cutter, an accumulator table to receive said bands, and an adjustable stop to hold said bands in an upright attitude on said table.

48. The apparatus according to claim 40, wherein said spreader includes an expandable frame for insertion within said tube and a guide for positioning said frame in relation to said cutter.

49. The apparatus according to claim 40, wherein said cutter is a guillotine cutter.

50. The apparatus according to claim 40, wherein said feeder includes a pair of drive rollers.

51. A method for converting a length of tubular fabric into a plurality of fabric bands for use in the manufacture of apparel collars, cuffs and bands, said method comprising the steps of:

(a) cutting said tubular fabric into longitudinal fabric strips with opposed edges;

(b) longitudinally folding said fabric strips and seaming said edges together to form a plurality of tubes; and (c) transversely cutting each of said tubes into bands having a predetermined width using a cutter; wherein said cutter includes a spreader adapted to spread a tube, a cutting blade adapted to transversely cut said tube into bands, and a feeder to feed said tube from said spreader to said cutting blade.

52. A slitter for an apparatus for converting a length of tubular fabric into a plurality of fabric bands for use in the manufacture of apparel collars, cuffs and bands, said slitter comprising:

(a) a fabric conveyor adapted to longitudinally convey said fabric, wherein said conveyor includes reciprocating means for lapping said fabric strips;

(b) a plurality of spaced fabric cutters to cut said fabric into a plurality of longitudinal fabric strips; and (c) a table positioned to receive said fabric strips, wherein said table includes an air-permeable top and a source of pressurized air to direct air upwardly through said top, whereby fabric strips are supported upon a cushion of air.

53. The apparatus according to claim 52, wherein said slitter includes a spreader frame for flattening said tubular fabric prior to cutting.

54. The apparatus according to claim 52, wherein said cutters comprise a plurality of rotating blades, and guide rails for positioning said blades to contact said fabric at pre-determined locations.

55. The apparatus according to claim 52, wherein said conveyor includes a horizontal guide bar positioned above said cutters and a pair of nip rollers positioned below said cutters.

56. A slitter for an apparatus for converting a length of tubular fabric into a plurality of fabric bands for use in the manufacture of apparel collars, cuffs and bands, said slitter comprising:

(a) a fabric conveyor adapted to longitudinally convey said fabric;

(b) a spreader frame for flattening said tubular fabric prior to cutting;

(c) a plurality of spaced fabric cutters to cut said fabric into a plurality of longitudinal fabric strips; and (d) a table positioned to receive said fabric strips, wherein said table includes an air-permeable top and a source of pressurized air to direct air upwardly through said top, whereby fabric strips are supported upon a cushion of air.

57. The apparatus according to claim 56, wherein said conveyor includes reciprocating means for lapping said fabric strips.

58. The apparatus according to claim 56, wherein said cutters comprise a plurality of rotating blades, and guide rails for positioning said blades to contact said fabric at pre-determined locations.

59. The apparatus according to claim 56, wherein said conveyor includes a horizontal guide bar positioned above said cutters and a pair of nip rollers positioned below said cutters.

60. A slitter for an apparatus for converting a length of tubular fabric into a plurality of fabric bands for use in the manufacture of apparel collars, cuffs and bands, said slitter comprising:

(a) a fabric conveyor adapted to longitudinally convey said fabric;

(b) a plurality of spaced fabric cutters to cut said fabric into a plurality of longitudinal fabric strips, wherein said conveyor includes a horizontal guide bar positioned above said cutters and a pair of nip rollers positioned below said cutters; and (c) a table positioned to receive said fabric strips, wherein said table includes an air-permeable top and a source of pressurized air to direct air upwardly through said top, whereby fabric strips are supported upon a cushion of air.

61. The apparatus according to claim 61, wherein said conveyor includes reciprocating means for lapping said fabric strips.

62. The apparatus according to claim 61, wherein said slitter includes a spreader frame for flattening said tubular fabric prior to cutting.

63. The apparatus according to claim 61, wherein said cutters comprise a plurality of rotating blades, and guide rails for positioning said blades to contact said fabric at pre-determined locations.

64. An apparatus for converting a length of tubular fabric into a plurality of fabric bands for use in the manufacture of apparel collars, cuffs and bands, said apparatus comprising:

(a) a slitter adapted to cut said tubular fabric into longitudinal fabric strips with opposed edges, said slitter including: (i) a plurality of spaced fabric cutters to cut said fabric into a plurality of longitudinal fabric strips; (ii) a fabric conveyor adapted to longitudinally convey said fabric into contact with said cutters; and (iii) a table positioned to receive said fabric strips, wherein said table includes an air-permeable top and a source of pressurized air to direct air upwardly through said top, whereby fabric strips are supported upon a cushion of air;

(b) means for separating adjacent plies of said longitudinal fabric strips into individual plies;

(c) a seamer adapted to longitudinally fold said individual plies of fabric strips and to seam said edges together to form a plurality of tubes; and (d) a cutter adapted to transversely cut each of said tubes into bands having a predetermined width.

65. The apparatus according to claim 64, wherein said means for separating adjacent plies of said longitudinal fabric strips is an overhead frame located upstream of said seamer having a plurality of rollers for separating said fabric strips.

66. The apparatus according to claim 64, wherein said seamer includes a folder adapted to fold the edges of said fabric strips together, an edge controller to position the edges of each of said fabric strips in position to be sewn, and a sewing machine to sew the edges of each of said fabric strips together to form a tube.

67. The apparatus according to claim 66, wherein said folder includes a pair of spaced, parallel outer guide strips having inner ends affixed to a supporting frame and inwardly curved outer ends integral with each other, and an inner guide strip having an inner end affixed to said supporting frame and an unattached outer end spaced from the outer ends of said outer guide strips, said inner guide strip being positioned parallel to, and equidistant between the said outer guide strips.

68. The apparatus according to claim 66, wherein said edge-controller includes a pair of freely rotatable, gripper wheels adapted to engage said fabric and move inwardly or outwardly to align said fabric with said sewing machine.

69. The apparatus according to claim 64, wherein said cutter adapted to transversely cut said tubes into bands having a predetermined width includes a spreader adapted to spread a tube, a cutting blade adapted to transversely cut said tube into bands, and a feeder to feed said tube from said spreader to said cutting blade.

70. The apparatus according to claim 69, wherein said cutter further includes a stacker for receiving bands from said cutter.

71. The apparatus according to claim 70, wherein said stacker includes a flipper plate to transfer said bands from said cutter, an accumulator table to receive said bands, and an adjustable stop to hold said bands in an upright attitude on said table.

72. The apparatus according to claim 69, wherein said spreader includes an expandable frame for insertion within said tube and a guide for positioning said frame in relation to said cutter.

73. The apparatus according to claim 69, wherein said cutter is a guillotine cutter.

74. The apparatus according to claim 69, wherein said feeder includes a pair of drive rollers.

75. The apparatus according to claim 64, wherein said conveyor includes reciprocating means for lapping said fabric strips.

76. The apparatus according to claim 64, wherein said slitter includes a spreader frame for flattening said tubular fabric prior to cutting.

77. The apparatus according to claim 64, wherein said cutters comprise a plurality of rotating blades, and guide rails for positioning said blades to contact said fabric at pre-determined locations.

78. The apparatus according to claim 64, wherein said conveyor includes a horizontal guide bar positioned above said cutters and a pair of nip rollers positioned below said cutters.

79. A method for converting a length of tubular fabric into a plurality of fabric bands for use in the manufacture of apparel collars, cuffs and bands, said method comprising the steps of:

(a) cutting said tubular fabric into longitudinal fabric strips with opposed edges using a slitter, said slitter including: (i) a plurality of spaced fabric cutters to cut said fabric into a plurality of longitudinal fabric strips; (ii) a fabric conveyor adapted to longitudinally convey said fabric into contact with said cutters; and (iii) a table positioned to receive said fabric strips, wherein said table includes an air-permeable top and a source of pressurized air to direct air upwardly through said top, whereby fabric strips are supported upon a cushion of air.

(b) separating adjacent plies of said longitudinal fabric strips into individual plies;

(c) longitudinally folding said individual plies of fabric strips and seaming said edges together to form a plurality of tubes; and (d) transversely cutting each of said tubes into bands having a predetermined width.

80. A method for converting a length of tubular fabric into a plurality of fabric bands for use in the manufacture of apparel collars, cuffs and bands, said method comprising the steps of:

(a) cutting said tubular fabric into longitudinal fabric strips with opposed edges;

(b) separating adjacent plies of said longitudinal fabric strips into individual plies;

(c) longitudinally folding said individual plies of fabric strips and seaming said edges together to form a plurality of tubes; and (d) transversely cutting each of said tubes into bands having a predetermined width.

81. A method for converting a length of tubular fabric into a plurality of fabric bands for use in the manufacture of apparel collars, cuffs and bands, said method comprising the steps of:

(a) longitudinally conveying said fabric using a fabric conveyor;

(b) cutting said fabric into a plurality of longitudinal fabric strips using a plurality of spaced fabric cutters; and (c) receiving said fabric strips onto a table, wherein said table includes an air-permeable top and a source of pressurized air to direct air upwardly through said top, whereby fabric strips are supported upon a cushion of air.

82. A method for converting a length of tubular fabric into a plurality of fabric bands for use in the manufacture of apparel collars, cuffs and bands, said method comprising the steps (a) cutting said tubular fabric into longitudinal fabric strips with opposed edges using a slitter, said slitter including: (i) a plurality of spaced fabric cutters to cut said fabric into a plurality of longitudinal fabric strips; and (ii) a fabric conveyor adapted to longitudinally convey said fabric into contact with said cutters;

(b) separating adjacent plies of said longitudinal fabric strips into individual plies;

(c) longitudinally folding said individual plies of fabric strips and seaming said edges together to form a plurality of tubes; and (d) transversely cutting each of said tubes into bands having a predetermined width.

83. A method for converting a length of tubular fabric into a plurality of fabric bands for use in the manufacture of apparel collars, cuffs and bands, said method comprising the steps of:

(a) longitudinally conveying said fabric using a fabric conveyor, wherein said conveyor includes reciprocating means for lapping said fabric strips;

(b) cutting said fabric into a plurality of longitudinal fabric strips using a plurality of spaced fabric cutters; and (c) receiving said fabric strips onto a table, wherein said table includes an air-permeable top and a source of pressurized air to direct air upwardly through said top, whereby fabric strips are supported upon a cushion of air.

84. A method for converting a length of tubular fabric into a plurality of fabric bands for use in the manufacture of apparel collars, cuffs and bands, said method comprising the steps of:

(a) longitudinally conveying said fabric using a fabric conveyor;

(b) flattening said tubular fabric prior to cutting using a spreader frame;

(c) cutting said fabric into a plurality of longitudinal fabric strips using a plurality of spaced fabric cutters; and (d) receiving said fabric strips onto a table, wherein said table includes an air-permeable top and a source of pressurized air to direct air upwardly through said top, whereby fabric strips are supported upon a cushion of air.

85. A method for converting a length of tubular fabric into a plurality of fabric bands for use in the manufacture of apparel collars, cuffs and bands, said method comprising the steps of:

(a) longitudinally conveying said fabric using a fabric conveyor;

(b) cutting said fabric into a plurality of longitudinal fabric strips using a plurality of spaced fabric, wherein said conveyor includes a horizontal guide bar positioned above said cutters and a pair of nip rollers positioned below said cutters; and (c) receiving said fabric strips onto a table, wherein said table includes an air-permeable top and a source of pressurized air to direct air upwardly through said top, whereby fabric strips are supported upon a cushion of air.

* * * * *